US006505792B1

(12) United States Patent
Rocheleau et al.

(10) Patent No.: US 6,505,792 B1
(45) Date of Patent: Jan. 14, 2003

(54) NON-CONTACT FLOATING DEVICE FOR TURNING A FLOATING WEB

(75) Inventors: Michael Rocheleau, Sobieski, WI (US); Donn DeNamur, Green Bay, WI (US)

(73) Assignee: MegTec Systems, Inc., DePere, WI (US)

( * ) Notice: Subject to any disclaimer, the term of this patent is extended or adjusted under 35 U.S.C. 154(b) by 0 days.

(21) Appl. No.: 09/724,307

(22) Filed: Nov. 28, 2000

(51) Int. Cl.[7] ..... B65H 23/24; B65H 23/32
(52) U.S. Cl. ..... 242/615.12; 226/97.3
(58) Field of Search ..... 242/615.12; 226/97.3

(56) References Cited

U.S. PATENT DOCUMENTS

| | | | | |
|---|---|---|---|---|
| 1,630,713 A | | 5/1927 | Meyer | |
| 2,689,196 A | | 9/1954 | Daniels | 117/103 |
| 3,097,971 A | | 7/1963 | Carlisle et al. | 134/15 |
| 3,127,080 A | | 3/1964 | Allander et al. | 226/97 |
| 3,156,398 A | * | 11/1964 | Lauxen et al. | 242/615.12 |
| 3,313,462 A | * | 4/1967 | Smith, Jr. | 242/615.12 |
| 3,567,093 A | * | 3/1971 | Johnson | 242/615.12 |
| 3,599,851 A | | 8/1971 | Hedlunt et al. | 226/97 |
| 3,954,213 A | | 5/1976 | Andersen | 226/7 |
| 4,182,472 A | | 1/1980 | Peekna | 226/97 |
| 4,197,972 A | | 4/1980 | Daane | 226/97 |
| 4,288,015 A | | 9/1981 | Curtin | 226/97 |
| 4,790,468 A | | 12/1988 | Nakashima et al. | 226/97 |
| 4,919,319 A | * | 4/1990 | Ford et al. | 242/615.12 |
| 4,925,077 A | | 5/1990 | Daane et al. | 226/97 |
| 4,938,404 A | | 7/1990 | Helms et al. | 226/10 |
| 5,172,844 A | * | 12/1992 | Mueller | 226/97.3 X |
| 5,242,095 A | * | 9/1993 | Creapo et al. | 242/615.12 |
| 5,317,817 A | | 6/1994 | Roberts et al. | 34/642 |

FOREIGN PATENT DOCUMENTS

| | | | | |
|---|---|---|---|---|
| GB | 2215711 A | * | 9/1989 | 242/615.12 X |
| WO | WO 92/11194 | * | 7/1992 | 242/615.12 X |

OTHER PUBLICATIONS

Merriam–Webster's Collegiate Dictionary, 10th ed., Merriam–Webster, Incorporated, 1996, p. 894.*

* cited by examiner

*Primary Examiner*—Kathy Matecki
*Assistant Examiner*—Minh-Chau Pham
(74) *Attorney, Agent, or Firm*—Mitchell D. Bittman; Kevin S. Lemack

(57) ABSTRACT

Air turn for supporting and optionally drying a web, comprising an arcuate surface having a plurality of apertures formed therein. Pressurized gas is supplied to the air turn plenum, and exits through the plurality of apertures to form a cushion of air to float the web. Turn angles of about 90° to about 300° with no contact to the web are achievable with the apparatus of the present invention. The unique semi-circular design allows for non-contact flotation and turning of a tensioned web with low pressure requirements, reduced air spillage and reduced noise level. Multi-chamber turns can be used with each section having independently controlled pressurized gas.

14 Claims, 6 Drawing Sheets

NON-CONTACT FLOATING DEVICE FOR TURNING A FLOATING WEB

FIELD OF THE INVENTION

The present invention relates to devices and methods for contactlessly drying and guiding traveling webs, and more particularly, an improved air flotation turning device and method particularly suitable for guiding the webs in an arcuate path.

BACKGROUND OF THE INVENTION

In web printing and drying operations, it is often desirable that the web be contactlessly supported in order to avoid damage to the web itself or to the coating (such as ink) previously applied to one or more surfaces of the web. One conventional arrangement for contactlessly supporting a web includes horizontal upper and lower sets of air bars between which the web travels. Hot air issuing from the air bars both dries and supports the web. Occasionally it becomes necessary to change the direction of web travel while maintaining the contactless environment. This can be accomplished using air turns, which are devices that support a flexible web on a cushion of air pressure as the web travels around a curved path. Air turns have a generally partially cylindrical surface through which pressurized air is introduced through various slots, holes or apertures, or other designs or patterns. Typical air turns which are commercially available are a 95° turn, which carries the web around a 95° arc, and a 20° "shallow wrap" turn, which carries the web around an arc of 20°.

Such air turns replaced grater rollers. Grater rollers were a means to turn the web utilizing frictional contact with the web. As a result, web marking problems often arose. Although the use of air turns eliminated marking problems, the absence of the additional frictional restraint provided by the rollers led to web tracking problems, especially in the case of "baggy" or non-uniform webs. To compensate for tracking problems, the air turn is used as a steering device. By tilting one edge of the air turn in a direction perpendicular to and toward the web, a force is provided tending to push the web away from that side. Conversely, if that end of the air turn were moved away from the web, the resulting air pressure forces pulls the web toward that end. Optical sensors are used to monitor web drift and send a signal to the steering drive motor controlling the position of the air turn. The drive motor moves the operator end of the air turn. Alternatively or additionally, the air turn could be tilted manually.

One example of an air turn is that disclosed in U.S. Pat. No. 4,182,472 (the disclosure of which is herein incorporated by reference). Specifically, a guide for contactless support of a running web as the latter changes directions is provided. The guide is formed as a drum-like member having an arcuately curved surface which can be variable as to the length of its arc, depending on the degree of turn or change of direction desired for the running web. A series of parallel grooves extending in the direction of web travel are formed in the arcuate surface of the drum-like member. An air nozzle extends along the length of the drum-like member and at each end of the groves, and pressurized air is fed through the nozzles so as to form a pneumatic cushion between the web and the arcuate surface and thereby float the web. The grooves in the arcuate surface act as labyrinth seals in inhibiting the transverse air flow out of the cushion and towards the edges of the running web.

A further example of an air turn is provided in U.S. Pat. No. 2,689,196, wherein a series of holes are formed in the cylindrical surface for the passage of pressurized air therethrough to support and guide a web passing over the drum. Similarly, U.S. Pat. No. 3,097,971 discloses a device having a series of slits in the curved supporting surface and which extend longitudinally and/or transversely to the web. Air under pressure is passed through these slits to form a cushion between the drum and the web.

An important aspect of any flotation system is the stability of the web as it passes over the air bar. Airflow instabilities near the web can induce web flutter and subsequent web contact with mechanical parts of the drying, resulting in coating or web damage. Web flutter can be manifested in a multitude of forms, ranging from a violent flapping of the web to a high frequency drumming.

Excessive web flutter has been encountered in conventional air turn applications. Where a plurality of air turns are used together so that the web follows a sinusoidal path, web flutter has been encountered as the web leaves the lower air turn and before it reaches the upper air turn.

It is therefore an object of the present invention to minimize or eliminate web flutter during the contactless support of a floating web.

It is a further object of the present invention to provide a flotation device with increased cushion pressure to properly float heavy or curled webs around the device.

It is still a further object of the present invention to provide a flotation device that results in uniform flotation height about the device even at different or fluctuating web tensions.

SUMMARY OF THE INVENTION

The problems of the prior art have been overcome by the present invention, which provides an air turn for supporting and optionally drying a web, the air turn comprising an arcuate surface having a plurality of apertures formed therein. Pressurized air is supplied to the air turn cavity, and exits through the plurality of apertures to form a cushion of air to float the web. Turn angles of about 90° to about 300° with no contact to the web are achievable with the apparatus of the present invention. The unique design allows for non-contact flotation and turning of a tensioned web with low pressure requirements, reduced air spillage and reduced noise level.

The shape of the apparatus allows for void or open areas inside the web entering and exiting the air turn. These void or open areas are critical in maintaining a stable web flotation entering and exiting the turn. The void areas created by the shape of the turn and the special size and spacing of the pressure slots make the turn superior in operation to conventional non-contact turning devices. Conventional turning devices can require as much as 30–50% higher pressure requirements that the device of the present invention.

DETAILED DESCRIPTION OF THE INVENTION

Figure 1:
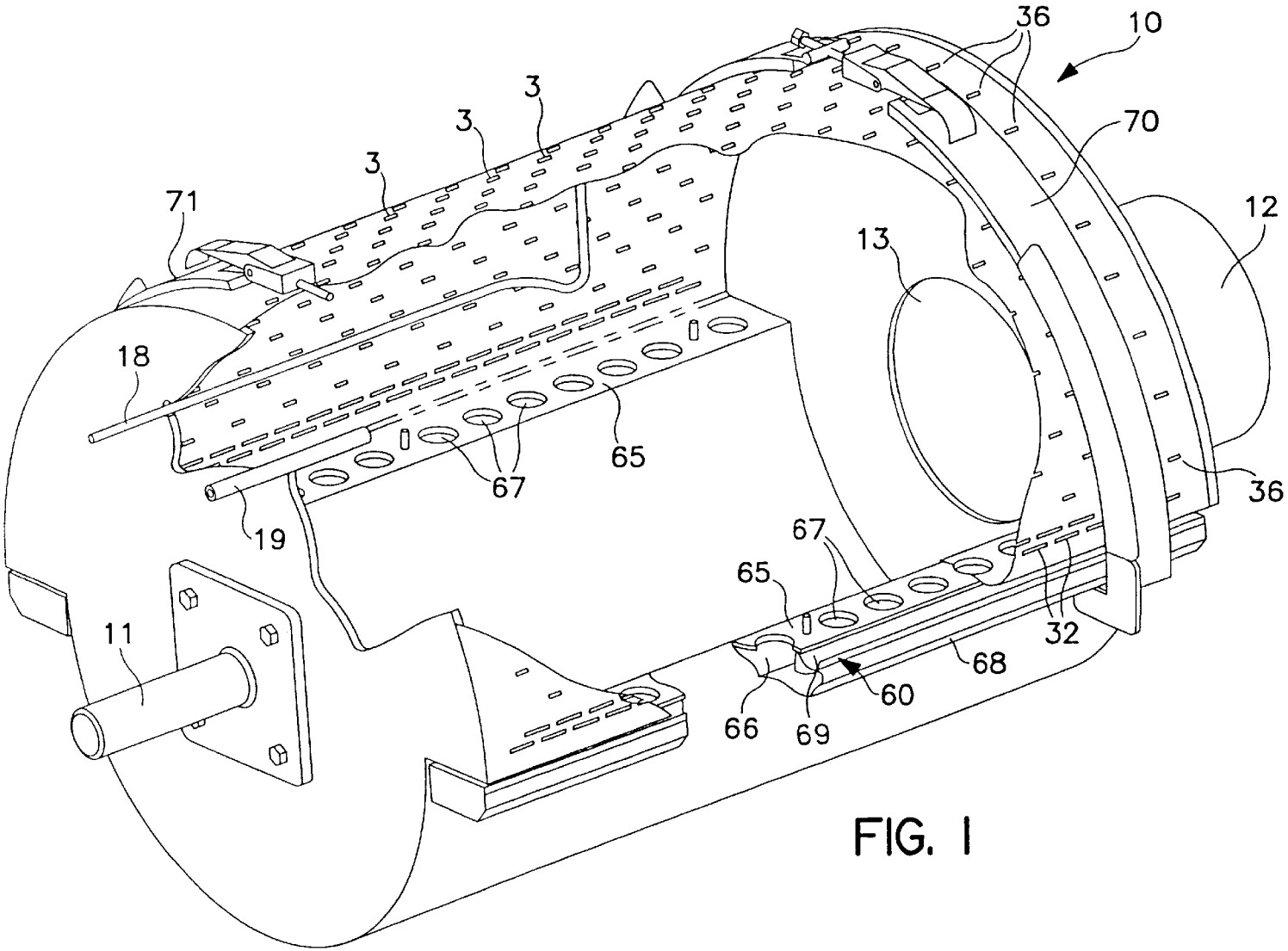
FIG. 1 is a perspective view of an air turn, with a portion removed to view the internals, in accordance with the present invention.

The web support provided by the present invention can support a moving web through various degrees of turning movement, but the present invention has been illustrated in FIG. 1 as showing a web support for an approximate 180° turn, wherein the web passes over and without contact with the support device 10. It should be understood that the following detailed description of the web support is for purposes of illustration and should not be construed as limiting of the present invention.

Figure 2:
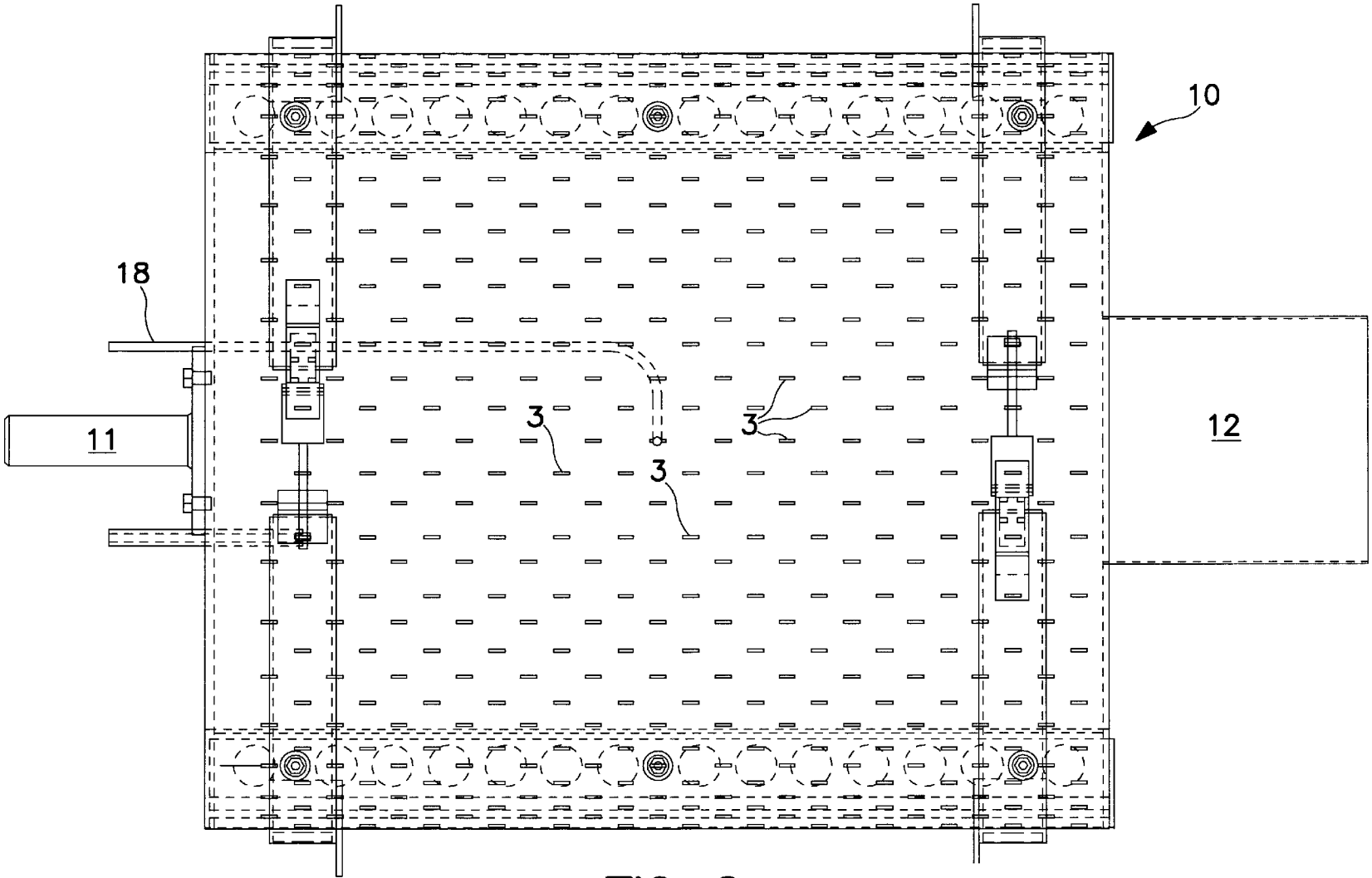
FIG. 2 is a top of an air turn in accordance with the present invention.

As seen in FIGS. 1 and 2, the support 10 is formed generally with an arcuate surface which extends across the width of the web to be supported, and preferably extends beyond the edges of the web. The support 10 has a mounting shaft 11 coupled to one lateral end of the support 10 for mounting the support 10 in a dryer or other suitable apparatus, such as in a festoon oven to create loops of the web for longer dwell or drying times in the oven, and a feed inlet 12 at the opposite, spaced lateral end of the support 10. In the embodiment shown, a series of substantially parallel or parallel slots 3 are formed in the surface of the support 10. The slots 3 preferably are generally rectangular in cross-section, but may assume other configurations as long as the effect thereof is to create a uniform discharge of pressurized air to support the web. Thus, apertures of circular, square, diamond, polygonal or other configuration are within the scope of the present invention. Uniform flotation height (e.g., 0.125 to 0.500 inches off the surface) around the entire turn 10 at different or fluctuating web tensions is achieved.

Figure 4:
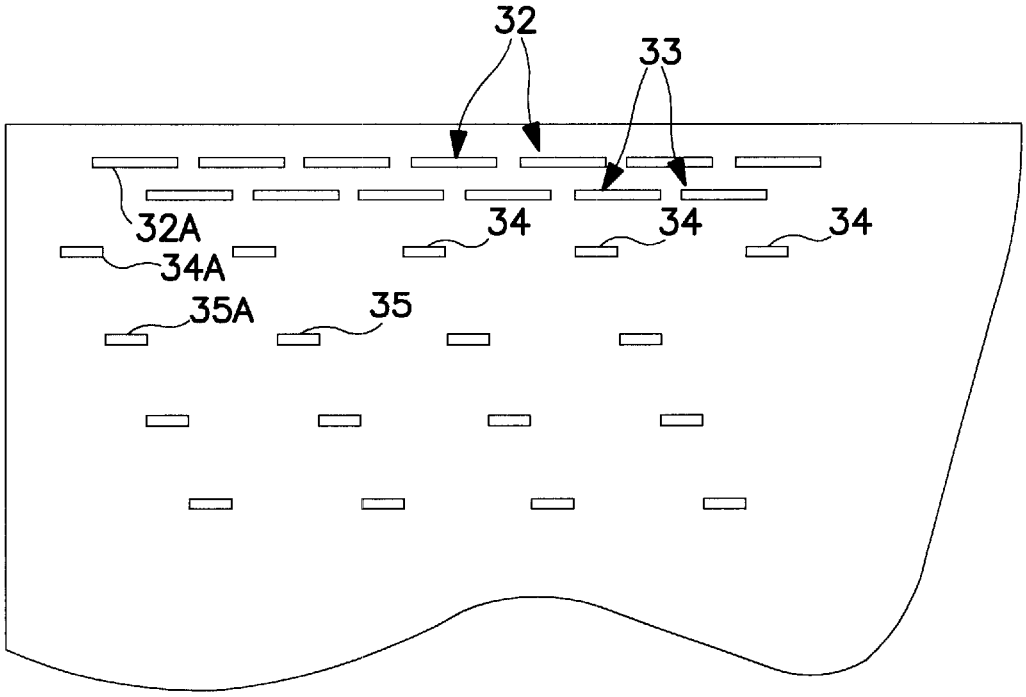
FIG. 4 is a top view of a portion of the surface of an air turn in accordance with the present invention.

FIG. 4 illustrates a preferred embodiment of the aperture layout for optimum performance. The portion of the air turn 10 depicted is of a corner of the air turn at the web entrance side. A first line of rectangular slots 32 are formed 0.38 inches from the turn entrance (and exit), with the center of the first slot 32A being 1.50 inches from the lateral end of the turn. These slots 32 are preferably the longest in length, being 0.125×1.000 inches and spaced on 1.125 inch centers. The larger slots 32 at the entrance and exit are important in that about 50% of the air from these slots 32 is lost over the entry and exit edge of the turn 10, thus more air is needed to support the web at these locations. A second row of slots 33 runs parallel to the first row, 0.38 inches from the first row, and are similarly dimensioned.

Proceeding in the direction of web travel, the rows of slots continue but are preferably further spaced from one another and are of smaller dimension. The smaller slot size is important in this location in order to maintain a uniform flotation height around the turn 10 and to reduce air volume and thus fan sizing necessary for the equipment. Thus, slots 34 are spaced 1.5 inches from the web entrance (and exit) end, are 0.100×0.500 inches, and are spaced from one another at 2.00 inch centers. The next row of slots 35 is spaced from the previous row by 1.00 inch. The first slot 35A in this row begins at the end of slot 34A of the previous row. This pattern continues over the length of the arcuate surface until the larger slots are reached at the exit end of the turn 10, having a pattern similar to the larger slots at the entry side as discussed above.

As shown in FIG. 1, the slots 36 at the lateral sides of the air turn 10 are also small to reduce air requirements.

By allowing the pressurized air to discharge through slots rather than small holes, the cushion pressure which supports the web is more uniform and maintains a stable float condition. This slot design allows for reduced pressure requirements and thus reduced fan horsepower, resulting in energy savings. With the use of alternating slots, coated webs are not adversely affected with lane modeling of the wet coating or heat streaking due to the drying aspect of the high velocity of the hole discharge design. The high pressure hole discharge velocities of conventional designs on a light weight web will cause corrugation or fluttering the web. With the alternating slot design of the present invention, a light weight web remains flat with no flutter.

Pressurized gas, preferably air, is supplied to the feed inlet 12 by a suitable supply such as a fan (not shown). The feed inlet 12 is in communication with the cavity or plenum of the support 10 via aperture 13 formed in the lateral end thereof. A cushion pressure tap 18 can be used to measure web support pressure. Fan supply pressure (the pressure from the fan that builds in the air turn plenum) also can be measured through port 19.

Figure 3:
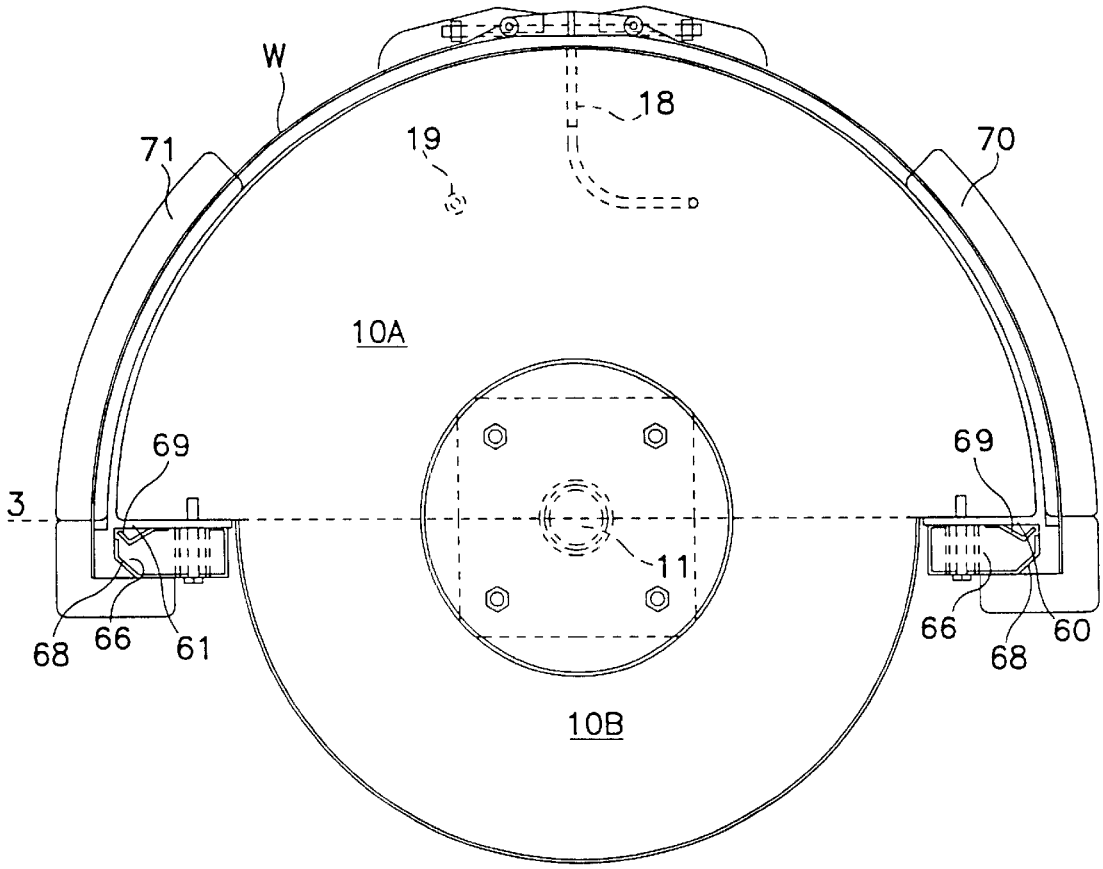
FIG. 3 is a side cross-sectional view of an air turn in accordance with the present invention.

Turning now to FIG. 3, the preferred configuration of a 180° air turn 10 is shown. This shape, with a 24 inch diameter, is the most common. The operative surface of the air turn 10 is a semi-circle, as defined by the area 10A above dotted line 3—3. A smaller semi-circle 10B below dotted line 3—3 defines, with area 10A, the air turn 10. The smaller semi-circle 10B has a maximum diameter less that the maximum diameter of the larger semi-circular 10A. Preferably the diameters differ by at least six inches. The semi-circular shape of the surface of the air turn 10 allows for air speed under the web W to decrease as the web W exits the turn, rather than follow a cylindrical shape and improperly pull the web W along that shape. In addition, web flutter or vibration induced from high velocity air spillage is reduced, and the shape is compact, allowing for easy installation into existing production lines. The half circle design also reduces the amount of support air that travels with the web as it leaves the turn.

FIGS. 1 and 3 also illustrate optional elongated entry and exit slots for increased cushion pressure to properly float heavy webs with edge curl. The slots 60, 61 are located on the opposite shoulders defined at the convergence of the semi-circular portions 10A and 10B. Each slot is comprised of an elongated flat perforated plate 65 through which pressurized air flows into a cavity 66. Preferably the perforations 67 in the plate 65 are circular as shown. Elongated V-shaped members 69 are respectively coupled to the underside of the perforated plate 65, and together with angled members 68, define between them the slots 60, 61. The V-shaped members 69 direct the flow of pressurized air along the arcuate surface of the turn 10. Preferably the slots 60, 61 extend the length of the arcuate surface as shown in FIG. 1.

Movable edge dams 70, 71 are optional and can be mounted on the surface of the air turn 10 and adjusted according to the width of the web to be floated.

In the event it is desired to enhance the drying of a coated web, the air used to float the web with the air turn of the present invention can be heated.

Figure 5:
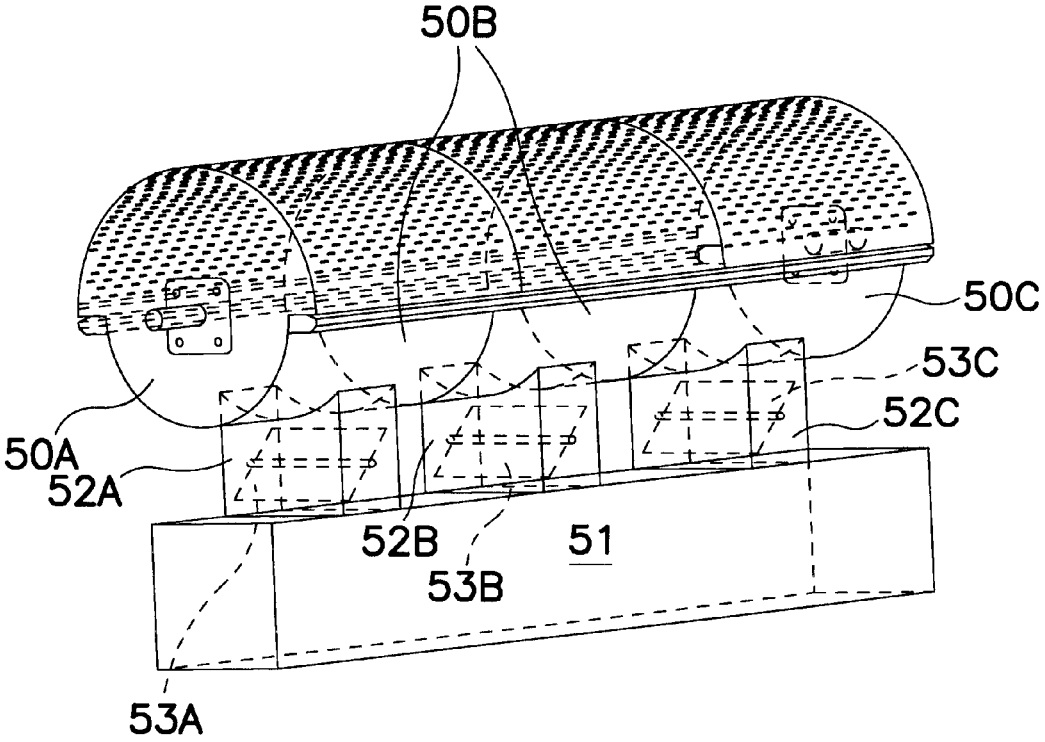
FIG. 5 is a perspective view of a multi-chamber embodiment of the present invention.
Figure 6:
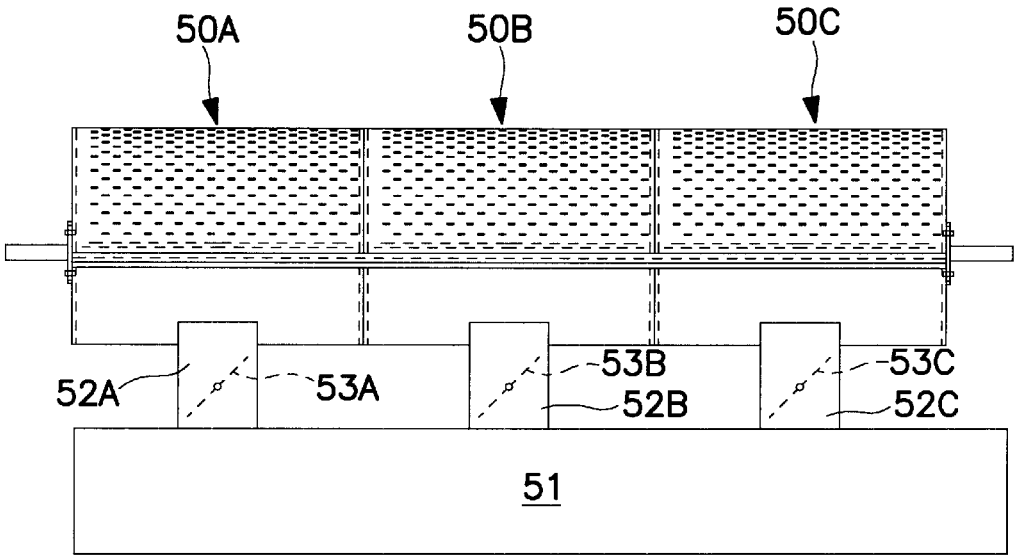
FIG. 6 is a front view of the embodiment of FIG. 5.

FIG. 5 illustrates an alternative embodiment of the present invention, which is particularly useful for longer full web widths. It is a multi-feed and multi-chamber unit wherein outside chambers can be shut off to conserve energy and reduce the amount of air spillage into the work area when running narrow width webs. Specifically, FIGS. 5 and 6 show a three-chamber device having chambers 50A, 50B and 50C, linearly aligned as shown. Each chamber is in fluid communication with a plenum 51 feeding pressurized air to the chambers via ducts 52A, 52B and 52C, respectively. A damper or other valving device 53A, 53B, 53C is appropriately positioned to control, regulate or modulate the flow of air into each chamber. Preferably, each chamber 50 has a corresponding damper, so that the flow of air into each chamber can be controlled independently. For example, when running narrow webs, the outside sections (e.g., 50A and/or 50C) can be dampered off or closed to save on fan volume. In addition, to control the web shift, the outside section in the direction of the shift can be pressurized higher than the other sections to force the web back to the center. Thus, by creating differential pressures in the multi-feed turn, one can pressurize the gear side of the web higher than the operator side of the web and consequently steer the web to the operator side, and vice versa. The turn can now be used to center the web on the process centerline and at the same time turn the web with no contact to the coated side.

What is claimed is:

1. A contactless web support comprising a perforated arcuate surface and over which a running web is floatingly supported, said arcuate surface having a plurality of spaced, rectangular perforations discontinuous with respect to each other at said arcuate surface, said arcuate surface having a first maximum diameter, and a bottom arcuate portion having a second maximum diameter less than said first maximum diameter, said perforated arcuate surface and said bottom arcuate portion defining a plenum, whereby pressurized gas in said plenum is discharged through the perforations to float said web about said perforated arcuate surface.

2. The web support of claim 1, wherein said perforated arcuate surface has a web entry point and a web exit point, and wherein said web support further comprises a pair of nozzles in gas-receiving communication with said plenum, one of said pair of nozzles being positioned at said web entry point and the other of said pair of nozzles being positioned at said web exit point.

3. The web support of claim 1, wherein said perforated arcuate surface has a web entry point and a web exit point, and wherein said perforations are arranged in parallel rows along said perforated arcuate surface such that the cross-sectional area of each of said perforations in the first two rows from said web entry point and of each of said perforations in the first two rows from said web exit point is larger than the cross-sectional area of each of the remaining perforations in said perforated arcuate surface.

4. The web support of claim 1, wherein said perforated arcuate surface has a web entry point and a web exit point, and wherein there is an angle between said web entry point and said web exit point, said angle being 90°.

5. The web support of claim 1, wherein said perforated arcuate surface has a web entry point and a web exit point, and wherein there is an angle between said web entry point and said web exit point, said angle being 180°.

6. The web support of claim 1, wherein said perforated arcuate surface has a web entry point and a web exit point, and wherein there is an angle between said web entry point and said web exit point, said angle being 300°.

7. The web support of claim 1, wherein said plurality of discontinuous perforations comprises a first row of a plurality of discontinuous rectangular slots and a second row of discontinuous rectangular slots spaced from said first row in the direction of web travel.

8. The web support of claim 7, wherein said first and second rows of discontinuous rectangular slots are parallel.

9. The web support of claim 7, wherein said plurality of discontinuous perforations further comprise at least one additional row of slots spaced from said second row in the direction of web travel, wherein the distance between said at least one additional row and said second row is greater than the distance between said first and second rows.

10. The web support of claim 9, wherein the slots in said at least one additional row of slots are smaller than said slots in said first row of slots.

11. The web support of claim 1, wherein said perforated arcuate surface has a web entry point and a web exit point, and wherein there is an angle between said web entry point and said web exit point, said angle being 300° or less.

12. Web support apparatus comprising a plurality of contactless web supports, each comprising a perforated arcuate surface, said arcuate surface having a plurality of rectangular perforations, spaced from one another in the web width direction and in the direction of web travel, and discontinuous with respect to each other at said arcuate surface, said arcuate surface having a first maximum diameter, and a bottom arcuate portion having a second maximum diameter less than said first maximum diameter, said perforated arcuate surface and said bottom arcuate portion defining a plenum, whereby pressurized gas in said plenum is discharged through the perforations to float said web about said perforated arcuate surface, each said plenum being in independent fluid communication with a source of said pressurized gas.

13. The web support apparatus of claim 12, further comprising a damper associated with each respective plurality of contactless web supports for independently controlling the flow of pressurized gas to a respective plenum.

14. A contactless web support comprising a perforated arcuate surface and over which a running web is floatingly supported, said arcuate surface having a plurality of discontinuous perforations with respect to each other at said arcuate surface, said arcuate surface having a first maximum diameter, and a bottom arcuate portion having a second maximum diameter less than said first maximum diameter, said perforated arcuate surface and said bottom arcuate portion defining a plenum, whereby pressurized gas in said plenum is discharged through the perforations to float said web about said perforated arcuate surface, said perforated arcuate surface having a web entry point and a web exit point, and wherein said perforations are arranged in parallel rows along said perforated arcuate surface such that the cross-sectional area of each of said perforations in the first two rows from said web entry point and of each of said perforations in the first two rows from said web exit point is larger than the cross-sectional area of each of the remaining perforations in said perforated arcuate surface.

* * * * *